United States Patent [19]

Allemand

[11] 4,050,337

[45] Sept. 27, 1977

[54] TURRET ALIGNMENT SYSTEM

[75] Inventor: Pierre M. Allemand, Cires-les-Mello, France

[73] Assignee: S.A. Beauplat Fils & Cie, France

[21] Appl. No.: 701,103

[22] Filed: June 30, 1976

[30] Foreign Application Priority Data

July 9, 1975 France ..... 75.21586

[51] Int. Cl.[2] ..... B26F 1/04; B23B 29/32

[52] U.S. Cl. ..... 83/552; 74/813 L; 74/815; 90/56 R; 90/57; 408/35

[58] Field of Search ..... 83/552; 74/813 L, 815; 90/56 R, 57; 408/35

[56] References Cited

U.S. PATENT DOCUMENTS

| | | | |
|---|---|---|---|
| 1,940,883 | 12/1933 | Rollings | 83/552 |
| 3,935,755 | 2/1976 | Daniels | 74/815 |

*Primary Examiner*—Donald R. Schran

*Attorney, Agent, or Firm*—Poms, Smith, Lande & Glenny

[57] ABSTRACT

Each chuck of the capstan is peripherally integral with a rim made from a relatively elastic material which defines, facing each indexing bore for the formation of a shock absorber/stop member, an orifice whose outlet cross-section is substantially the same as the inlet cross-section of the said bore and, in the vicinity of the indexing pin a cross-section which, at least in the direction of travel of the chuck, is larger than the cross-section of the end fitting of the said pin, each orifice having a sloping wall which converges towards the central area of the said chuck.

The improvements forming the object of the invention are applicable to capstan tool holders for punching machines.

6 Claims, 6 Drawing Figures

FIG. 4
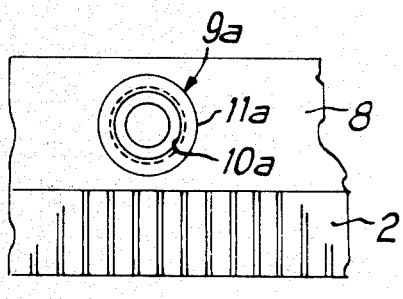
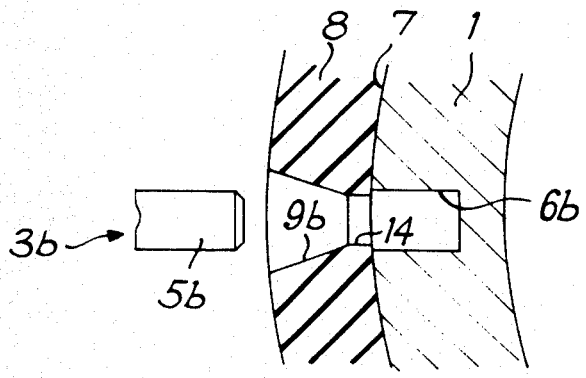
FIG. 5

TURRET ALIGNMENT SYSTEM

BACKGROUND OF THE INVENTION

The present invention relates to improvements to capstan tool holders for punching machines.

Capstans of this type comprise a punch holder chuck and a die holder chuck, which are spaced from one another to permit the passage of the plates to be machined. These two chucks are kinematically connected to a rotary drive mechanism in such a way that their respective movements are precisely synchronized, without slipping.

According to a first constructional form, the drive mechanism makes it possible to drive the chucks at high speed during the search of the selected tool and at low speed during the approach of the said tool to the punching station. This drive mechanism comprises a chuck which frees the two synchronized chucks, whilst leaving them coupled to one another when the selected tool has reached the said punching station.

According to a second constructional form, the drive mechanism only has a single high speed which is used during the search of the selected tool. However, it cooperates with brakes acting on the two chucks, in order to slow them down during the above-mentioned approach phase. Moreover, the drive mechanism also has a clutch acting in the manner described hereinbefore.

In both the above constructional forms, each chuck is dependent on a selection device comprising detecting members, such as proximity detectors, microswitches or the like, mounted about the capstan on the fixed frame which supports the latter and distributed in the same way as the tools. The selection device also comprises a cam for actuating the said detection devices, carried by the chuck in question. The appropriately programmed control logic mobilises the detection device which must be actuated by the cam in order to bring the selected tool to the punching station and neutralises the other members, so that when the said detection member is actuated by the said cam it emits a control signal.

Moreover, by means of the above-mentioned selection device, each chuck is made dependent on an indexing device comprising a pin carried by the fixed frame, but radially displaced towards the chuck in question or parallel to the rotation axis of the said chuck so as to penetrate one of the bores made in the periphery of the latter and distributed in the same way as the tools.

The control signal emitted by the selection device has the effect of controlling either the brakes or the change-speed gear of the drive mechanism, disengaging the latter and actuating the indexing pins so that they penetrate the selected bores of the two chucks, in order to precisely immobilise the latter. This is achieved in that each pin and the holes are precisely shaped in complementary manner and in that contact is established between non-deformable and durable metal surfaces thereof.

BRIEF SUMMARY OF THE INVENTION

The present invention has for its object the elimination in one case of the brakes and in the other case of the change-speed gear so as to considerably simplify construction, facilitate controls, reduce the overall dimensions and considerably reduce the cost.

It also has for its object the increase in the capstan rotation speed during the tool change operation, which makes it possible to reduce wasted time to the extent that the operating speed of the punching machine is not influenced by the operating time of the capstan.

It finally has for its object the reduction of the noise occurring during the indexing operation, to the extent that the noise level can be tolerated by the stringent industrial regulations in this field.

The improvements according to the invention are based on the fact that each chuck is peripherally integral with at least one shock absorber/stop member made from a relatively elastic material which is resistant to shocks, friction and lubricants, whereby the shock absorber/stop member defines, facing each indexing bore of the chuck in question, an orifice which has, in the vicinity of this bore, a cross-section which is substantially the same as the inlet cross-section of the said bore and, in the vicinity of the indexing pin and inlet cross-section which, at least in the peripheral direction of travel of the said chuck is larger than the extreme cross-section of the said pin and whereby each orifice has, between its inlet cross-section and its outlet cross-section a wall which slopes in convergent manner towards the central area of the said chuck.

According to a particularly advantageous embodiment, the shock absorber/stop member is a rim made from an elastomer, such as a urethane, said rim being integral with the periphery of the corresponding chuck.

The outlet cross-section of each orifice is circular, whilst its inlet cross-section is oblong and oriented in the chuck travel direction. The outlet cross-section of each orifice is slightly smaller than the inlet cross-section of the corresponding indexing bore, so as to substantially eliminate noise.

BRIEF DESCRIPTION OF THE DRAWINGS

Other and further objects of the present invention will be apparent from the description and claims and are illustrated in the accompanying drawings which, by way of illustration shown preferred embodiments of the invention and the principles thereof, and what are now considered to be the best modes contemplated for applying these principles. Other embodiments of the invention embodying the same or equivalent principles may be used and structural changes may be made if desired by those skilled in the art without departing from the invention and the scope of the appended claims. In the drawings show:

FIG. 4 a view analogous to FIG. 2 showing a second embodiment.

FIG. 5 a view analogous to FIG. 3 showing a third embodiment, adapted to a different type of indexing pin.

DETAILED DESCRIPTION OF THE PREFERRED EMBODIMENTS

Figure 6:
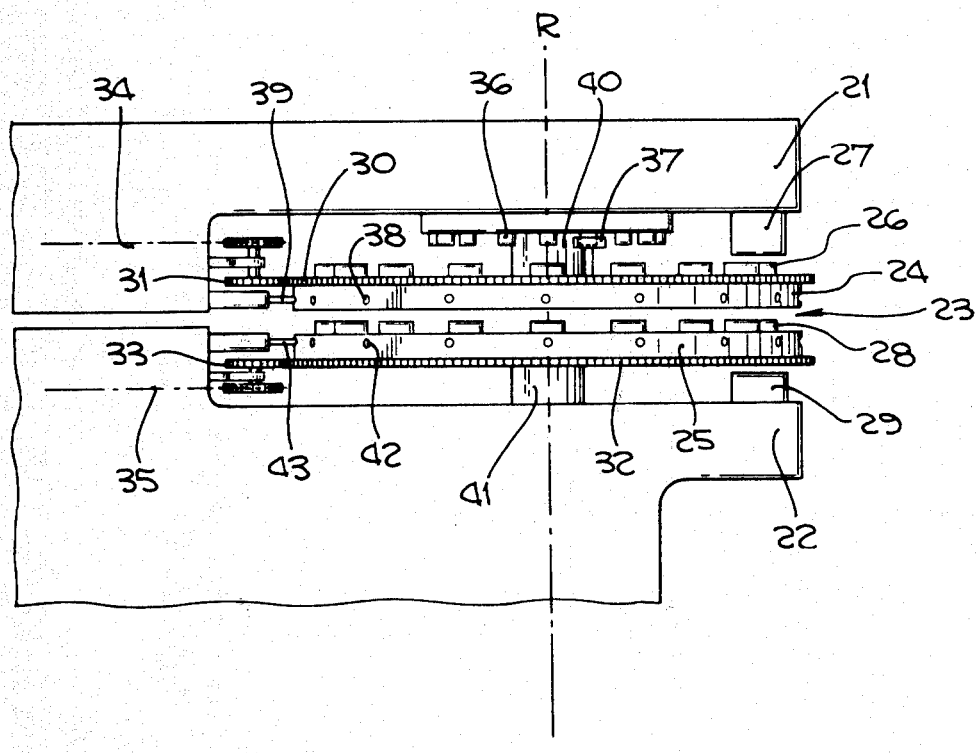
FIG. 6 is a side view of the turret press that utilizes the improvements of the present invention.

Referring first to FIG. 6, the turret press of the present invention is shown. The present invention is referred to as a capstan tool holder, and it includes two chucks 24 and 25 mounted on spaced apart arms 21 and 22 respectively. Chucks 24 and 25 are spaced apart at space 23. Upper chuck 24 rotates through shaft 40, and lower chuck 25 rotates through shaft 41. The rotation of both chucks is about a common axis of rotation R.

Punches 26 are provided close to the periphery of chuck 24. They are locked in place except when situated beneath punching block 27, fitted on arm 21. Die-plates 28 are similarly fitted near the periphery of chuck 25. Die-plates 28 are aligned with punches 26. Chuck 25 may rest on anvil 29 during punching.

Toothed ring 30 is integral with the periphery of chuck 24, and toothed ring 32 is integral with the periphery of chuck 25. Toothed rings 30 and 32 are driven by pinions 31 and 33 respectively. The pinions are connected to a common driving block by transmissions 34 and 35 which rotates the chucks at the same velocity. This driving device is controlled by a selecting device to bring the selected punching tool (one punch 26 and one die-plate 28) aligned with punching block 27 and anvil 29. The selecting device includes a fixed detecting device 36 situated concentrically to the axis of rotation R and are spaced about the axis similar to the spacing of punches 26. The detecting devices cooperate with a control cam 37 which rotates on chuck 24.

The improvement of the present invention is provided to immobilize the two chucks 24 and 25 with protection so that the punch and the die-plate of the selected tools are facing each other. Therefore, an indexing device is provided. Chuck 24 includes a series of holes 38 along the periphery of chuck 24, each hole corresponding to a punch 26 and spaced similarly about the periphery of chuck 24. Indexing pins 39 moves radially into and out of holes 38. Chuck 25 includes a series of holes 42 similar to the holes 38 on chuck 24. Indexing pin 43 moves into and out of holes 42. The movement of the indexing pins is controlled in a well-known manner by the selection device 36.

The above-described invention has been improved in the following manner. Reference numerals for FIGS. 1 through 5 do not necessarily correspond to those in FIG. 6.

In the drawings, 1 designates either of the chucks of a tool holder capstan, 2 is the peripheral toothed rim, integral with the chuck and connected to the rotary drive mechanism and 3 is an indexing pin guided perpendicularly to the axis of rotation 4 of the chuck at a spindle (not shown) supported by bearings of a fixed frame (not shown).

Figure 2:
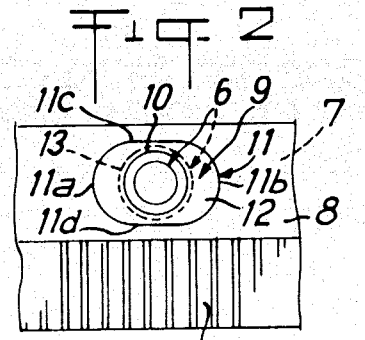
FIG. 2 a part side elevation along the line II—II of FIG. 1.
Figure 1:
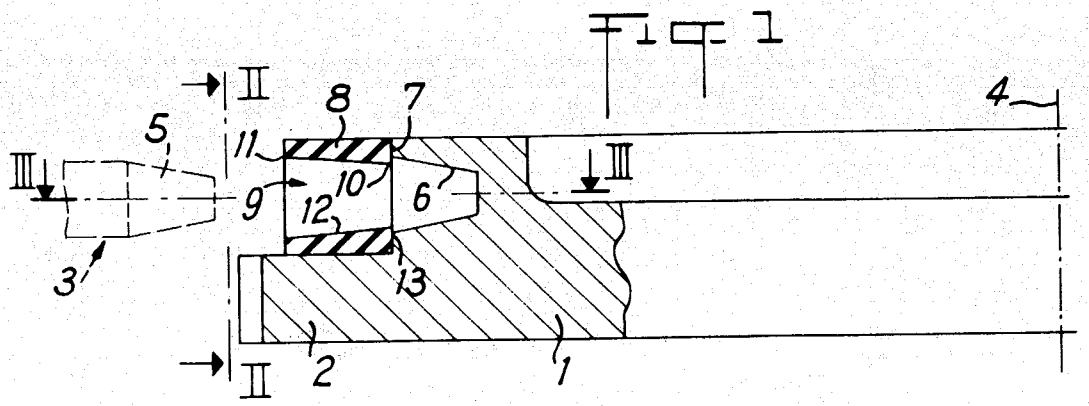
FIG. 1 a part front elevation, of which part has been removed within radial section a first embodiment of the improvements according to the invention.
Figure 3:
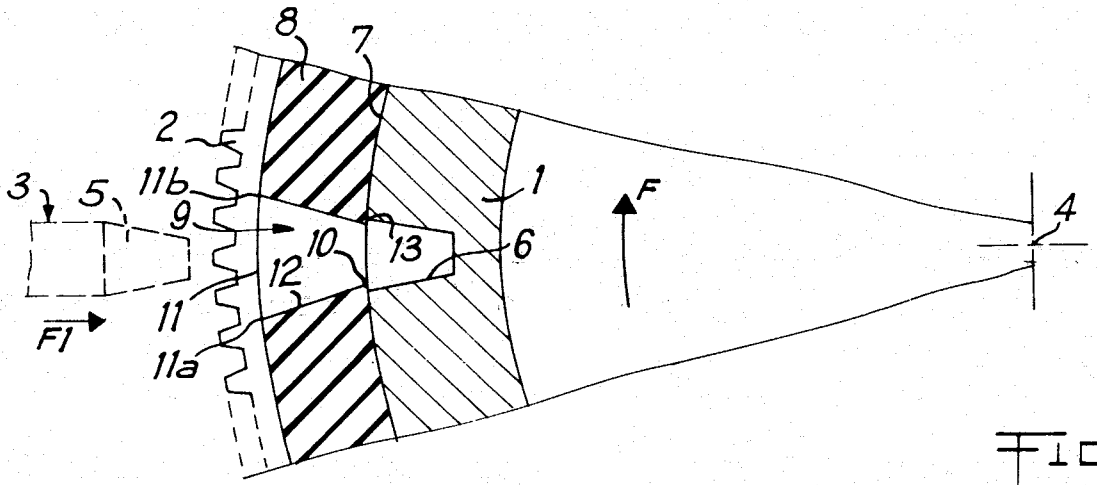
FIG. 3 a part plan section along the line III—III of FIG. 1.

In the embodiment of FIGS. 1 to 3, the end fitting 5 of the indexing pin 3 is frustum-shaped and cooperates selectively with the also frustum-shaped bores 6, made in the peripheral path 7 of chuck 1. Moreover, pin 3 is slidingly mounted in a guidance member, not shown, of the fixed frame and connected to a actuating member, not shown, making it possible to move the same from the position illustrated in dotted lines in FIGS. 1 and 3 allowing the chuck to rotate to a position in which the end fitting 5 is completely embedded in the selected bore 6 and immobilised the chuck.

If no brake or low-speed gear slows the drive mechanism, the chucks rotate at a relatively high speed when disengaged. The invention proposes to stop them by means of the indexing pins 3, while preventing any risk of damage to the end fittings 5 and/or bores 6 due to the violent shock caused by the inertia of the chucks during contact, but while maintaining a very accurate positioning of the capstan and also avoiding the impact noise from being too intense, being in all cases within the range permitted by the most stringent standards.

According to the embodiment shown in FIGS. 1 to 3, a rim 8 surrounds the path 7 of chuck 1 and is fixed thereto by all appropriate means such as screws, pins, adhesive, etc. Rim 8 is made from a relatively hard, elastic material which perfectly resists shocks, friction and lubricants. For example, the rim can be made from a synthetic elastomer, such as a urethane or a polyurethane.

For each bore 6, the rim constitutes shock absorber means for absorbing shocks when the pin penetrates the bore to stop the chuck. To this end it has orifices 9 facing the corresponding bore 6 via an outlet opening 10 having a circular cross-section. The inlet openings of the orifices at the outside of rim 8 pass in front of the end fitting 5 of the indexing pin. This inlet opening 11 is oblong and is defined by two semicircular edges 11*a*, 11*b*, connected by substantially rectilinear edges 11*c*, 11*d*, extending orthogonally to the rotation axis 4, i.e. parallel to the peripheral direction of rotation of chuck 2. Between the openings 10 and 11, each orifice 9 has a sloping wall 12, converging towards the central area of the said chuck.

Under these conditions, when chuck 1 rotates in the direction of arrow F (FIG 3), being disengaged for the approach of the selected bore 6, the indexing pin 3 is translated in the direction of arrow F1. Its end fitting 5 then penetrates the corresponding orifice 9 in the vicinity of the edge 11*b* of inlet opening 11. While pin 3 continues its penetration, the chuck continues to rotate, and sloping wall 12 of orifice 9 abuts against end fitting, 5 and successively rebounds between side 11*a*, and side 11*b*. The amplitude of this oscillating movement progressively decreases with the penetration of end fitting 5, orifice 9 becoming narrower. When end fitting 5 has substantially entered bore 6, rim 8 stops oscillating and chuck 1 is immobilised. As soon as the metal surfaces of the end fitting and the bore are in contact, the positioning of the chuck is realigned with conventional precision. The above explanations clearly show that the rim 8, for each of the orifices 9 constitutes a shock absorber and stop member, as a result of which the conventional braking or slowing down means can be eliminated. End fitting 5 of indexing pin 3 cannot be damaged or worn, and the speed of the chuck during the search of the tools can be considerably increased.

Moreover, FIGS. 1 to 3 show, in exaggerated form for reasons of clarity, that the diameter of outlet opening 10 of each orifice 9 is slightly smaller than the diameter of inlet orifice 13 of the corresponding bore 6. This leads to a slight braking at the end of travel of indexing pin 3 and consequently an almost total elimination of noise resulting from contact between the surfaces of end fitting 5 and of bore 6.

According to a second embodiment illustrated in FIG. 4, the orifices 9*a* of rim 8 are frustum-shaped and their inner wall extends between two openings 11*a* and 10*a* which are circular and concentric. Obviously, the diameter of the inlet openings 11*a* is sufficiently large to obtain the previously described damped oscillations.

A third embodiment is shown in FIG. 5 and is for the case where the indexing pin 3*b* is cylindrical, including at the position of end position 5*b* which is chamfered. In this case bores 6*b* are also cylindrical. So that the rim 8 fulfils its function of a shock absorber and stop member while permitting the centering of end fitting 5*b* of indexing pin 3 facing the selected bare 6*b*, each convergent orifice 9*b* is extended in the vicinity of its outlet opening by a cylindrical guidance portion 14, whose diameter can be slightly smaller than the diameter of bore 6*b*.

Obviously, when the indexing pin is displaceable parallel to the axis of rotation, orifices 9, 9*a* or 9*b* issue onto the visible annular face of rim 8 of each chuck instead of issuing onto the cylindrical edge of the latter. Moreover, in both cases, rim 8 can be replaced by a plurality of plugs, each defining at least one orifice 9, 9*a* or 9*b*. In this case, the plugs can be embedded and fixed in the periphery 7 of chuck 1.

The invention is not limited to the embodiments described and represented hereinbefore and various modifications can be made thereto without passing beyond the scope of the invention.

What is claimed is:

1. In a capstan tool holder for a punching machine comprising two chucks spaced apart for the passage of sheets to be machined, one chuck being equipped with punches and the other chuck being equipped with dies, a selection device for selecting the position of the chucks, each chuck being connected to a rotary drive mechanism that selectively disengages the drive mechanism under control from the selection device, an indexing device controlled by the selection device and having a displaceable pin on a fixed portion of the machine to penetrate a selected bore on the periphery of the chuck the improvement comprising the provision of: shock absorber means made from a relatively elastic material on the periphery of the chuck about each bore for absorbing shocks when the pin penetrates the bore to stop the chuck, the shock absorber means comprising an orifice aligned with the bore, the cross-section of the orifice at the end adjacent the bore being substantially the same as the cross-section of the bore adjacent the orifice, the outside of the orifice having a cross-section which, at least in the direction of rotation of the chuck is larger than the cross-section of the pin, and wherein each orifice has a sloping wall which converges toward the central area of the chuck.

2. The improvement of claim 1, wherein the shock absorber means comprises a rim made from an elastomer, said rim being made integral with the periphery of the corresponding chuck.

3. The improvement of claim 1, wherein the cross-section of the orifice adjacent the bore is circular, and its inlet cross-section at the outside of the orifice is oblong and having its greater dimension in the direction of rotation of the chuck.

4. The improvement of claim 1, wherein the cross-sections adjacent each end of each orifice are circular and connected by a frustum-shaped wall.

5. The improvement of claim 3, wherein the orifice comprises a cylindrical portion between the bore and the frustum-shaped wall for guiding the free end of the indexing pin.

6. The improvement of claim 1, wherein the cross-section of each orifice at the bore is slightly smaller than the cross-section of the corresponding indexing bore at the orifice.

* * * * *

UNITED STATES PATENT AND TRADEMARK OFFICE

CERTIFICATE OF CORRECTION

PATENT NO. : 4,050,337

DATED : September 27, 1977

INVENTOR(S) : Pierre M. Allemand

It is certified that error appears in the above-identified patent and that said Letters Patent are hereby corrected as shown below:

Column 3, line 26, change "protection" to - - precision - -.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*